US005105634A

United States Patent [19]

Utter

[11] Patent Number: 5,105,634

[45] Date of Patent: Apr. 21, 1992

[54] SCROLL APPARATUS HAVING A MODIFIED TIP SEAL GROOVE

[75] Inventor: Robert E. Utter, Onalaska, Wis.

[73] Assignee: American Standard Inc., New York, N.Y.

[21] Appl. No.: 605,596

[22] Filed: Oct. 29, 1990

[51] Int. Cl.[5] ..... F01C 1/04; F01C 19/08

[52] U.S. Cl. ..... 62/498; 418/55.4; 418/142; 277/204

[58] Field of Search ..... 418/55.4, 142; 62/498; 277/204

[56] References Cited

U.S. PATENT DOCUMENTS

| | | | |
|---|---|---|---|
| 4,415,317 | 11/1983 | Butterworth | 418/55.4 |
| 4,498,852 | 2/1985 | Hiraga | 418/55.4 |
| 4,753,583 | 6/1988 | Hiraga et al. | 418/55.4 |
| 4,840,549 | 6/1989 | Morishita et al. | 418/188 |
| 4,869,658 | 9/1989 | Tsutsumi et al. | 418/55.4 |
| 4,928,503 | 5/1990 | Riffe | 418/55.4 |
| 4,969,810 | 11/1990 | Stolle et al. | 418/55.4 |

FOREIGN PATENT DOCUMENTS

| | | | |
|---|---|---|---|
| 63-173874 | 7/1988 | Japan | 418/55.4 |

*Primary Examiner*—John J. Vrablik

*Attorney, Agent, or Firm*—William J. Beres; William O'Driscoll; David L. Polsley

[57] ABSTRACT

In a scroll apparatus having interleaving scroll wraps secured to end plates rotating about parallel, non-concentric axes to produce a relative orbital motion, a modified tip seal groove in the tip surface of at least one of the scroll wraps. In the preferred embodiment, the tip seal element is of constant cross-sectional width along the scroll wrap, with the groove in the scroll wrap tip having an inner portion adjacent the discharge port and an outer portion. The inner portion of the groove is of greater cross-sectional width than the outer portion of the groove.

12 Claims, 3 Drawing Sheets

FIG. 3
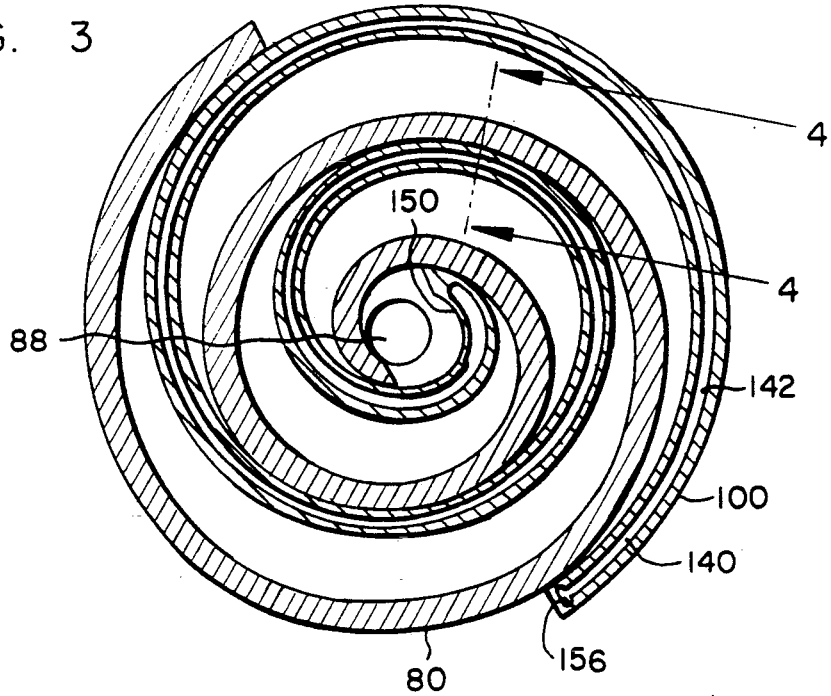
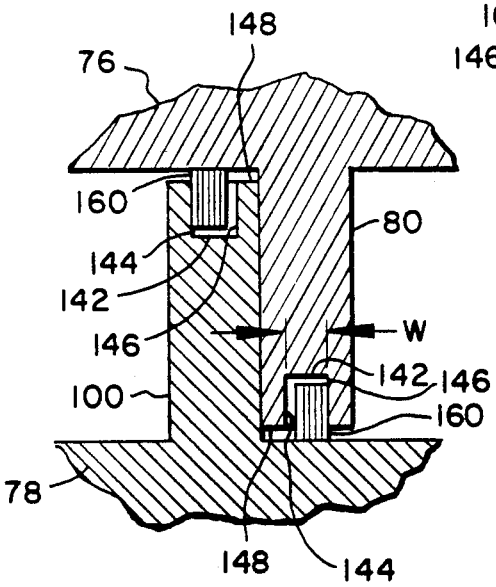
FIG. 4
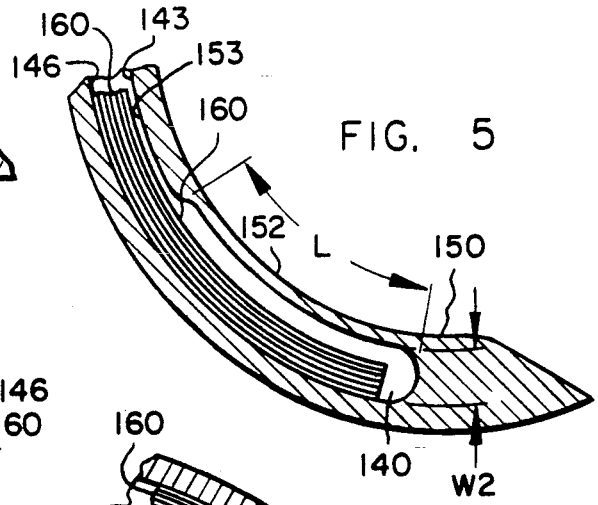
FIG. 5
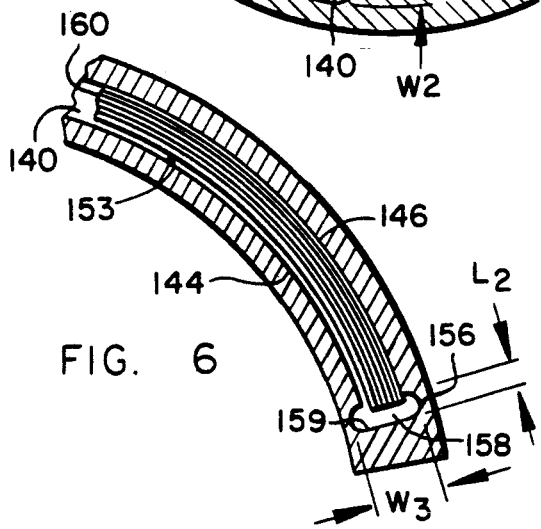
FIG. 6

SCROLL APPARATUS HAVING A MODIFIED TIP SEAL GROOVE

DESCRIPTION

1. Technical Field

This invention generally pertains to scroll apparatus and specifically to scroll-type fluid apparatus having a tip seal disposed in a groove in the tip surface of one or both of the scroll wrap elements.

2. Background Art

Scroll apparatus for fluid compression or expansion are typically comprised of two scroll members including upstanding interfitting involute spiroidal or scroll wraps which are generated about respective axes. Each respective involute wrap is mounted upon or integral with an end plate and has a tip surface disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radial exterior end of the scroll wraps to the radially interior ends of the scroll wraps for fluid compression, or from the radially interior end of the respective scroll wraps for fluid expansion. The scroll wraps, to accomplish the formation of the chambers, are placed in interleaving engagement and put in relative orbital motion by a drive mechanism which constrains the scrolls to relative non-rotational motion. This is true whether both scrolls are in rotation or one scroll is fixed. The general principles of scroll wrap generation and operation are discussed in numerous patents, such as U.S. Pat. No. 801,182.

Scroll apparatus are also typically provided with a tip seal disposed in the tip surface of the scroll wrap. The tip seal is usually disposed in a tip seal groove formed in the tip surface, the groove being typically slightly wider than the tip seal to permit compliant movement of the tip seal within the tip seal groove. Compliant movement of the tip seal is necessary in many scroll apparatus to ensure sealing contact between the tip seal of the scroll wrap and the end plate of the opposing scroll member, since there are often minor variations in the scroll apparatus arising due to manufacturing tolerances. These variations may include imperfect parallelism between the scroll end plates, scroll wrap height variations in the scroll wrap supporting the tip seal and imperfect surface flatness of the opposing scroll end plate.

While there are many variations of the tip seal and corresponding tip seal groove cross-sectional conformation, the most typical tip seal is rectangular, and may be formed from metal, plastic or rubber compounds. The tip seal may be either one-piece, but more typically the tip seal is a composite of laminated strips for greater strength and resistance to failure. The tip seal is usually formed in a continuous strip so that it may be cut to the desired length.

The typical rectangular groove is formed by milling a slot in the tip surface of the scroll wrap member, which results in the tip seal groove having a hemicylindric inner and outer end with a radius equal to the radius of the milling cutter used to form the slot. The hemicylindric ends of the tip seal groove have presented a problem, however, in that the tip seal, when moving within the groove, may be forced into the hemicylindric end of the groove. This can result in a temporary "pinching" or binding of the tip seal within the groove at that end, which also temporarily prevents the necessary compliant movement of the tip seal and can deform the tip seal at the ends. This binding effect is often exacerbated at the inner end of the tip seal, as the tip seal is formed to the smallest radii at this point and hence the tip seal material is the stiffest in this portion of the tip seal.

Therefore it is an object of the present invention to provide a scroll apparatus having a scroll wrap tip seal which is not subject to binding at the ends thereof due to the conformation of the tip seal groove.

It is a further object of the present invention to provide such a scroll apparatus which is of high efficiency and high operating reliability.

Finally, it is an object of the present invention to provide such a scroll apparatus as is suitable for and is relatively inexpensive in mass production.

SUMMARY OF THE INVENTION

The subject invention is a scroll apparatus having a tip seal disposed in a groove having a modified tip seal profile.

Specifically, the subject invention includes a scroll wrap having a tip surface in which is formed a tip seal groove having an inner portion generally adjacent the discharge port and an outer portion extending from the inner portion. The inner portion of the tip seal groove has a relatively larger cross-sectional area than the outer portion of the tip seal groove. This enlarged inner portion provides increased space for the tip seal where the tip seal must be formed to the smallest radii, thus improving the compliant movement of the tip seal in the inner portion and preventing "pinching" or binding of the tip seal at the innermost end thereof.

In an alternative embodiment, the tip seal groove also includes a modified outer end portion which is enlarged at the outer end of the tip seal groove to prevent pinching or binding of the tip seal at the outermost end thereof.

An exemplary co-rotational scroll apparatus which may suitably employ the subject invention is also presented.

BRIEF DESCRIPTION OF THE DRAWINGS

FIG. 3 shows a cross-sectional view of the scroll apparatus of FIG. 1 taken along section lines 3—3.

FIG. 4 shows a cross-sectional view of scroll apparatus of FIG. 3 taken along section lines 4—4.

FIG. 5 shows an alternative embodiment of the subject invention.

FIG. 6 shows another alternative embodiment of the subject invention.

DESCRIPTION OF THE PREFERRED EMBODIMENT

Figure 1:
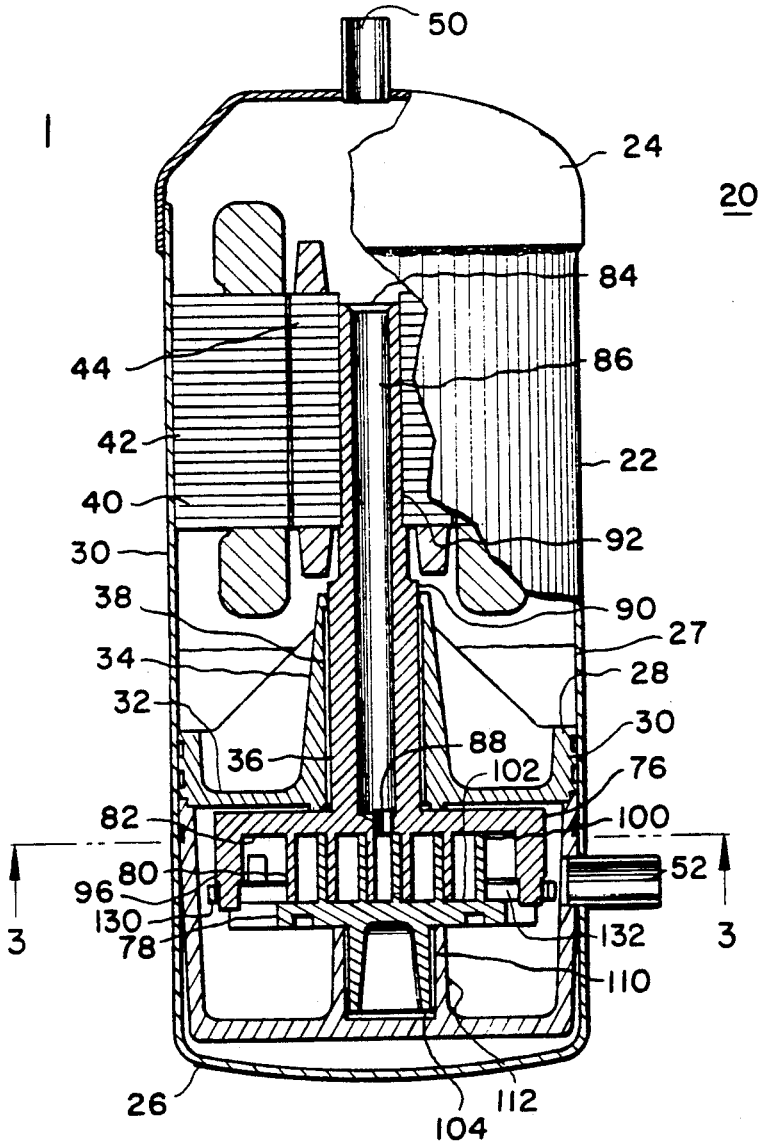
FIG. 1 discloses a cross-sectional view of a co rotational scroll apparatus embodying the subject invention.

A scroll type fluid apparatus generally shown in FIG. 1 as a scroll compressor assembly is referred to reference numeral 20. As the preferred embodiment of the subject invention is a hermetic scroll compressor assembly, the scroll apparatus 20 is interchangeably referred to as a scroll compressor 20 or as a compressor assembly 20. It will be readily apparent that the features of the subject invention will lend themselves equally readily to use in a scroll apparatus acting as a fluid expander, a fluid pump, or to scroll apparatus which are not of the hermetic type.

In the preferred embodiment, the compressor assembly 20 includes a hermetic shell 22 having an upper portion 24, a lower portion 26, a central exterior shell 27 extending between the upper portion 24 and lower portion 26, and an intermediate, central frame portion 28 affixed within the central exterior shell 27. The exterior shell 27 is a generally cylindrical body, while the central frame portion 28 is defined by a generally cylindrical or annular exterior portion 30 and a central portion 32 disposed across one end thereof. The annular exterior portion 30 of the central frame portion 28 is sized to sealingly fit within the exterior shell 27 so that it may be mated thereto by a press fit, by welding, or by other suitable means.

Integral with the central frame portion 28 is a generally cylindrical upper bearing housing 34, which is substantially coaxial with the axis of the annular exterior portion 30. A drive shaft aperture 36 extends axially through the center of the upper bearing housing 34, and an upper main bearing 38 is disposed radially within the drive shaft aperture 36. Preferably, the upper main bearing 38 is made, for example, of sintered bronze or similar material, but may also alternatively be a roller or ball-type bearing, for accepting a rotating load therein.

A motor 40 is disposed within the upper portion 24 and central shell portion 27 of the hermetic shell 22. The motor 40 is preferably a single-phase or three-phase electric motor comprised of a stator 42 which is circumferentially disposed about a rotor 44, with an annular space formed therebetween for permitting free rotation of the rotor 44 within the stator 42 as well as the flow of lubricant or refrigerant fluid.

It will be readily apparent to those skilled in the art that alternative types of motors 40 and means of mounting motor 40 would be equally suitable for application in the subject invention. For example, the stator 42 could be secured within the central shell portion 27 by a press fit therebetween. Alternatively, a plurality of long bolts or cap screws (not shown) may be provided through appropriate apertures in the stator plates into threaded apertures in the central frame portion 28 for securing the motor 40 within the hermetic shell 22.

The scroll arrangement includes a first scroll member 76 and a second scroll member 78, each having an upstanding involute scroll wrap for interfitting engagement with the other respective scroll wraps. The first scroll member 76 includes an upstanding first involute scroll wrap 80 which is integral with a generally planar drive scroll end plate 82. The drive scroll end plate 82 includes a central drive shaft 84 extending oppositely the upstanding involute scroll wrap 80. A discharge gallery 86 is defined by bore extending centrally through the axis of the drive shaft 84. The discharge gallery 86 is in flow communication with a discharge aperture 88 defined by a generally central bore through the drive scroll end plate 82. The drive shaft 84 further includes a first, relatively large diameter portion 90 extending axially through the upper main bearing 38 for a free rotational fit therein, and a second relatively smaller diameter portion 92 which extends axially through the rotor 44 and is affixed thereto. The rotor 44 may be affixed to the rotor portion 92 of the drive shaft 84 by such means as a press fit therebetween or a power transmitting key in juxtaposed keyways. The first scroll member 76 also includes two radially opposed extension members 96 extending adjacent the scroll wrap 80 near the outer periphery of the scroll end plate 82.

The second or idler scroll member 78 includes a second, idler scroll wrap 100 which is disposed in interfitting contact with the driven scroll wrap 80. The idler scroll wrap 100 is an upstanding involute extending from an idler end plate 102. Two rectilinear idler key stubs extend upwardly on the idler end plate 102. The idler key stubs (not shown) are disposed at radially opposed positions outside the idler scroll wrap 100. An idler stub shaft 104 extends from the idler end plate 102 oppositely the idler scroll wrap 100.

An annular drive ring 130 is disposed in sliding contact with the idler end plate 102. The drive ring 130 includes four equally radially spaced slots 132, with two slots 132 in sliding engagement with the extension members 96 and two slots 132 (not shown) in sliding engagement with the idler key stubs (not shown). The extension members 96 transfer drive torque through the drive ring 130 to the idler key stubs 103, thus functioning as a drive means and ensuring concurrent rotation of the first and second scroll members 76 and 78. There are various equally suitable alternative drive means for rendering operational the co-rotational scroll apparatus 20, and no further detailed discussion of the drive means is believed to be necessary herein.

The designation of the drive scroll member 76 as the first scroll member and the idler scroll member 78 as the second scroll member must be understood as arbitrary, made for the purposes of ease of description and therefore not as a limitation. It would be equally accurate to designate the idler scroll member 78 as the first scroll member and the drive scroll member 76 as the second scroll member. Those skilled in the art will also readily understand that the description of the subject invention as applied to a co-rotational scroll apparatus is exemplary rather than limiting, and that the subject invention may be applied to conventional scroll apparatus or to any scroll apparatus having means for causing relative orbital motion between the respective scroll wraps.

An annular bearing 110, which may be a sleeve bearing made of sintered bronze material or other similar material, or may be of the roller or ball-type, is disposed within an annular wall defining an idler bearing housing 112 which is integral with the lower hermetic shell portion 26 as a support means for rotationally supporting the second or idler scroll member 78.

Figure 2:
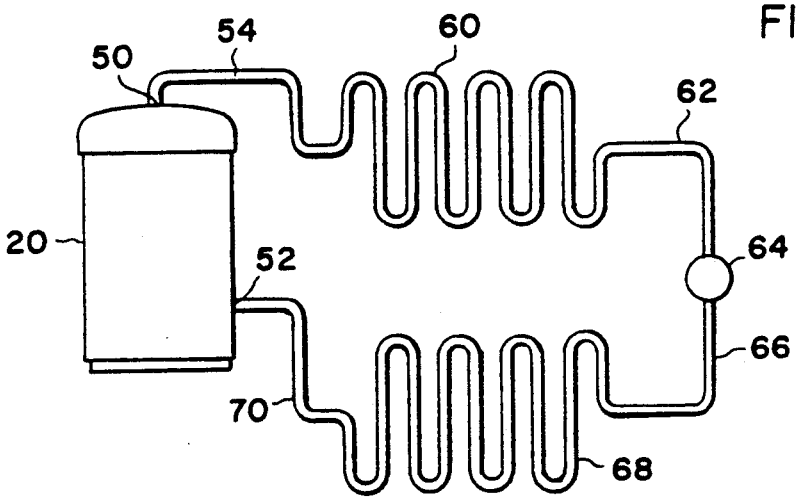
FIG. 2 discloses in schematic representation a refrigeration system in which the subject invention could be suitably employed.

In FIG. 2, the scroll compressor assembly 20 is shown connected at the discharge aperture 50 and the suction aperture 52 to a fluid system such as generally is used in refrigeration or air conditioning systems. Those skilled in the art will appreciate that this is but one fluid system in which the scroll compressor assembly 20 could suitably be utilized, and that application of the scroll compressor assembly 20 in refrigeration and air conditioning systems is to be taken as exemplary rather than as limiting.

The refrigeration system, shown generally in schematic representation in FIG. 2 in connection with the scroll compressor assembly 20, includes a discharge line 54 connected between the shell discharge aperture 50 and a condenser 60 for expelling heat from the refrigeration system and in the process typically condensing the refrigerant from vapor form to liquid form. A line 62 connects the condenser 60 to an expansion device 64. The expansion device 64 may be a thermally actuated or electrically actuated valve operated by a suitable controller (not shown), a capillary tube assembly, or other suitable means of expanding the refrigerant in the system. Another line 66 connects the expansion device 64 to an evaporator 68 for transferring expanded refrigerant from the expansion device 64 to the evaporator 68 for the acceptance of heat and typically the evaporation of the liquid refrigerant to a vapor form. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using suitably a scroll compressor apparatus 20 are well understood in the art, and that further detailed explanations of the devices and mechanisms suitable for constructing such a refrigeration system need not be discussed in detail herein. It is believed that it will also be apparent to those skilled in the art that such refrigeration or air conditioning systems may include multiple units of the compressor assembly 20 in parallel or series type connection, as well as multiple condensers 60, evaporators 68, or other components and enhancements such as subcoolers and cooling fans and so forth as are believed known in the art.

FIG. 3 discloses a cross-sectional view of FIG. 1 which more clearly discloses the subject invention. In FIG. 3, a cut-away view of the scroll apparatus 20 is shown. The cross-sectional view is taken through the tip seal groove 140 of the idler scroll wrap 100 at the tip seal groove base 142.

FIG. 4, a partial cross-sectional view of FIG. 3, shows the tip seal groove 140 more clearly. The tip seal groove 140 is preferably identical in both the driven scroll wrap 80 and the idler scroll wrap 100. Each tip seal groove 140 preferable includes a groove base 142, an inner groove wall 144 and an outer groove wall 146 spaced a width W from the inner wall 144. The groove walls 144 and 146 are preferably parallel to each other and perpendicular to both the tip seal groove base 142 and to the tip surface 148 of the respective scroll wraps 80 and 100. The tip seal groove 140 also has an inner end 150 adjacent the discharge port 88 and an outer end 156 which are shown in FIGS. 5 and 6, respectively, and described more fully hereinafter. A tip seal groove central portion 153 extends between the tip seal groove inner end 150 and the tip seal groove outer end 156.

As defined for purposes of this disclosure, inner shall refer to points which are either linearly or radially closer to the central bore which defines the discharge port 88, while outer refers to points, locations, or items which are farther from the discharge port 88. Therefore, the inner groove wall 144 of the tip seal groove 140 is that wall which is linearly closer to the discharge port 88, and the outer groove wall 146 is that wall which is linearly farther from the discharge port 88. Likewise, the inner end 150 is that end of the tip seal groove 140 which is radially closer to the discharge port and the outer end 146 is that end of the tip seal groove 140 which is radially farther out or away from the discharge port.

A tip seal 160 is shown disposed in the tip seal groove 140 of each scroll wrap 80 and 100. As shown, the preferred embodiment of the tip seal 160 is a laminate which is rectangular in cross-section, extending out of the tip seal groove 140 to contact the opposing scroll end plate. To enable compliant movement of the tip seal 160, the height of the tip seal 160 is less than that of the tip seal groove base 142 to the opposing scroll end plate and the width of the tip seal 160 is less than that of the space between the inner and outer tip seal groove walls 144 and 146. This also provides a bypass space into which fluid may flow from the higher pressure adjoining compression chamber. The fluid in the bypass space acts on the tip seal 160 to improve the sealing action. It must be understood that the width of the tip seal 160 can be only slightly less than the width of the tip seal groove 140, or the liklihood of leakage past the tip seal 160 is greatly increased.

Figure 3A:
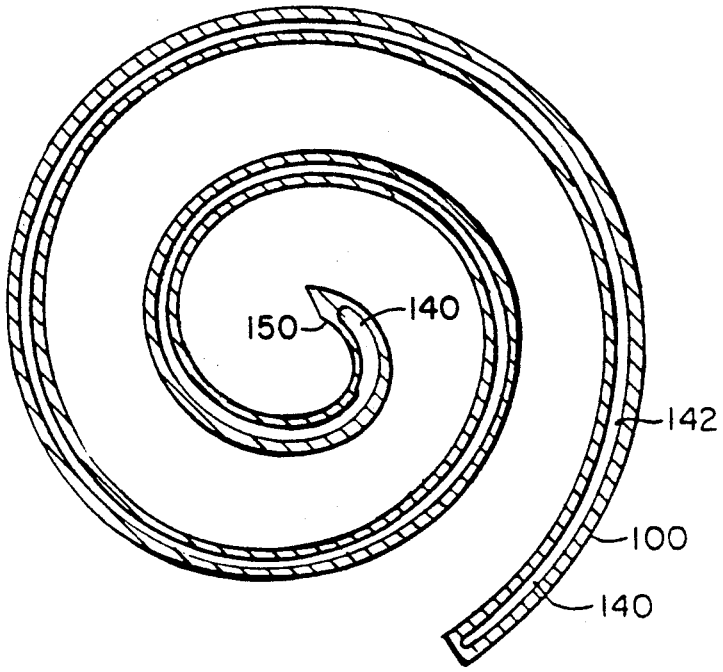
FIG. 3*a* shows an alternative embodiment of the scroll apparatus as shown in FIG. 3.

FIG. 5 shows an enlarged view of the groove inner end 150, as shown in FIG. 3 and the alternative embodiment as shown in FIG. 3*a*. The tip seal groove includes an inner portion 152 extending from the groove inner end 150 for a length L along the inner wall 144. The inner portion 152 is delineated by an inner wall portion which is also parallel to the groove outer wall 146, but which is spaced a width W2 from the groove outer wall 146. Since the tip seal 160 is typically manufactured from a fairly stiff material, such as steel, it becomes progressively more difficult to conform the tip seal 160 to the tip seal groove 140 as the radius of the required bend decreases toward the groove inner end 150, and the tip seal 160 therefore tends to be progressively less compliant. The width W2 of the tip seal groove 140 in the portion L is greater than the width W and permits the tip seal 160 greater space for compliant movement in that portion of the tip seal 160 which is conformed to the smallest radius. The length L of the inner portion wall 152 is preferably relatively short so as to prevent twisting of the tip seal 150 in the tip seal groove 140. For example, in the preferred embodiment, the length L is substantially equivalent to the diameter of the discharge port 88.

Figure 3B:
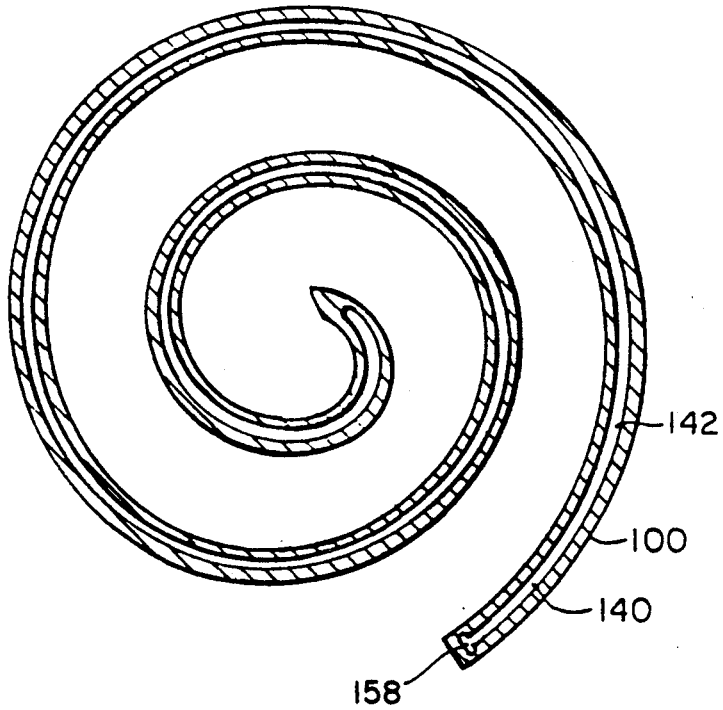
FIG. 3*b* shows a second alternative embodiment of the scroll apparatus as shown in FIG. 3.

FIG. 6 shows an enlarged view of the outer end 158, as shown in FIG. 3 and the alternative embodiment as shown in FIG. 3*b*. In the embodiment according to FIG. 6, the tip seal groove 140 is provided with an outer end groove 158 of length L2 which is generally perpendicular to the tangent of the tip seal groove 140. The outer end groove 158, having a width of W3, is wider than the tip seal groove width W and therefore serves as a relief space for the outer end of the tip seal 160. Also, because the outer end groove 158 is wider than the tip seal groove 140, the outer wall 159 of the outer end groove 158 serves as a planar outer end for the tip seal groove 140. Since the outer end of the tip seal 160 is typically planar and perpendicular to the groove walls 144 and 146, the outer end of the tip seal 160 is parallel to the planar outer wall 159. In the event that the tip seal 160 moves within the tip seal groove 140 and comes into contact with the planar outer wall 159, the tip seal 160 will not be deformed or otherwise prevented from the necessary compliant movement. The length L2 of the outer end groove 158 can therefore be relatively short, as is shown in FIG. 6.

It will be apparent to those skilled in the art that any combination of the modifications of the tip seal groove 140 shown in FIGS. 3, 3*a* and 3*b* can be readily implemented. Since many scroll manufacturing processes are completed on numerically controlled or microprocessor driven machines, it will be appreciated that the modifications can be completed by appropriately directing the cutter employed. For example, in forming the tip seal groove 140, a vertical mill may be employed with a cutter having a diameter less that the groove width W. The cutter centerline is set to pass one-half of the cutter diameter from the outer wall 146 and then to make a second cutting pass with the centerline set one-half of the cutter diameter from the cutter inner wall 144. In order to form the inner portion wall 152 according to FIG. 5, the cutter is set toward the inner groove wall 152 an additional distance equal to the difference between W2 and W. In order to form the outer end groove 159, the cutter is stopped at the outer groove end 156 and moved along a line perpendicular to the tangent of the tip seal groove 140 at that point for a distance sufficient to form the planar outer end 159 of width W.

An alternative method of manufacture would involve the casting of the scroll wraps 80 and 100 with the tip seal groove 140 including the modifications of FIG. 3*a* or 3*b*, or both, without need for further machining operations.

However implemented, it will be apparent to those skilled in the art that the modifications of the tip seal groove 140 as shown herein are readily and inexpensively implemented, and provide substantial improvement in the operation of tip seal 160 in the scroll apparatus 20 by improving the compliance of the tip seal 160 while preventing undesirable deformation thereof.

Modifications to the preferred embodiments of the subject invention will be apparent to those skilled in the art within the scope of the claims that follow:

What is claimed is:

1. A scroll apparatus comprised of:

a hermetic shell having a suction pressure portion for containing a suction pressure fluid and a discharge pressure portion for containing a discharge pressure fluid;

a first scroll member disposed in said hermetic shell, said first scroll member having a first scroll end plate including a first upstanding scroll wrap disposed on said first end plate, said scroll wrap having a tip surface on said scroll wrap, said scroll wrap further defining in said tip surface a tip seal groove having a central portion of width W extending between an inner end and an outer end groove portion having a width W3, said width W3 being greater than the width W;

a second scroll member disposed in said hermetic shell, said second scroll member having a second scroll end plate including a second upstanding scroll wrap disposed on said second end plate for interleaving engagement with said first scroll wrap; and means for causing relative orbital motion between said first scroll member and said second scroll member.

2. The scroll apparatus as set forth in claim 1 wherein said groove outer end portion is of length L2.

3. The scroll apparatus as set forth in claim 1 wherein said groove outer end portion further includes a planar outer wall.

4. A co-rotational scroll apparatus comprised of:

a hermetic shell having a suction pressure portion for containing a suction pressure fluid and a discharge pressure portion for containing a discharge pressure fluid;

a first scroll member disposed in said hermetic shell, said first scroll member having a first scroll end plate including a first upstanding scroll wrap disposed on said first end plate, said scroll wrap having a tip surface on said scroll wrap, said scroll wrap further defining in said tip surface a tip seal groove having a central portion of width W extending between an inner end including a groove inner end portion having a width W2, said width W2 being greater than the width W, and an outer end groove portion having a width W3, said width W3 being greater than the width W;

a second scroll member disposed in said hermetic shell, said second scroll member having a second scroll end plate including a second upstanding scroll wrap disposed on said second end plate for interleaving engagement with said first scroll wrap; and means for causing relative orbital motion between said first scroll member and said second scroll member.

5. The scroll apparatus as set forth in claim 4 wherein said tip seal groove width W is defined by an inner groove wall and an outer groove wall.

6. The scroll apparatus as set forth in claim 5 wherein said groove inner end portion is further defined by an inner wall portion parallel to and spaced said width W2 from said outer groove wall.

7. The scroll apparatus as set forth in claim 6 wherein the outer groove wall of said tip seal groove defined in said scroll wrap is continuous between said inner portion and said central portion of said tip seal groove.

8. The scroll apparatus as set forth in claim 6 wherein said scroll apparatus further includes a tip seal wherein said tip seal is disposed in said inner portion, said central portion and said outer portion of said tip seal groove.

9. The scroll apparatus as set forth in claim 6 wherein said inner wall portion is of length L.

10. The scroll apparatus as set forth in claim 4 wherein said groove outer end portion is of length L2.

11. The scroll apparatus as set forth in claim 10 wherein said groove outer end portion further includes a planar outer end wall.

12. A refrigerator system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and sending the refrigerant to the condenser, said compressor comprised of:

a hermetic shell having a suction pressure portion for containing a suction pressure fluid and a discharge pressure portion for containing a discharge pressure fluid;

a first scroll member disposed in said hermetic shell, said first scroll member having a first scroll end plate including a first upstanding scroll wrap disposed on said first end plate, said scroll wrap having a tip surface on said scroll wrap, said scroll wrap further defining in said tip surface a tip seal groove having a central portion of width W extending between an inner end including a groove inner end portion having a width W2, said width W2 being greater than the width W, and an outer end groove portion having a width W3, said width W3 being greater than the width W;

a second scroll member disposed in said hermetic shell, said second scroll member having a second scroll end plate including a second upstanding scroll wrap disposed on said second end plate in interleaving engagement with said first scroll wrap; and means for causing relative orbital motion between said first scroll member and said second scroll member.

* * * * *